US008177154B1

(12) United States Patent
Hoover

(10) Patent No.: US 8,177,154 B1
(45) Date of Patent: May 15, 2012

(54) MULTI-PURPOSE YARN CREEL ADAPTER

(75) Inventor: Donald Lynn Hoover, Clover, SC (US)

(73) Assignee: American Linc, LLC, Gastonia, NC (US)

( * ) Notice: Subject to any disclaimer, the term of this patent is extended or adjusted under 35 U.S.C. 154(b) by 0 days.

(21) Appl. No.: 12/589,070

(22) Filed: Oct. 16, 2009

(51) Int. Cl.
*B65H 49/20* (2006.01)

(52) U.S. Cl. ..... 242/131; 242/594.6; 248/593; 248/274.1

(58) Field of Classification Search ..... 242/131–131.1, 242/594.6, 594.5, 594.4, 594, 591, 560, 560.2, 242/559.1, 559.2, 559, 558; 66/125 R; 248/309.2, 248/316.1; 28/190
See application file for complete search history.

(56) References Cited

U.S. PATENT DOCUMENTS

| | | | | |
|---|---|---|---|---|
| 1,260,069 | A * | 3/1918 | Sawtell | 242/131 |
| 1,465,359 | A | 8/1923 | Holt et al. | |
| 2,483,160 | A * | 9/1949 | Suggs | 242/131.1 |
| 2,961,185 | A | 11/1960 | Seigle | |
| 3,321,152 | A | 5/1967 | Poore et al. | |
| 4,545,547 | A | 10/1985 | Singer | |
| 4,572,458 | A | 2/1986 | Bluhm et al. | |
| 4,728,055 | A * | 3/1988 | Wright et al. | 242/130 |
| 4,836,468 | A * | 6/1989 | Singer | 242/131 |

FOREIGN PATENT DOCUMENTS

WO WO 9307316 A1 * 4/1993

* cited by examiner

*Primary Examiner* — William E Dondero
(74) *Attorney, Agent, or Firm* — Schwartz Law Firm, P.C.

(57) ABSTRACT

A multi-package yarn creel adapter mounts on a creel adjacent a textile machine. The yarn creel adapter includes a base designed for being carried by the creel. A plurality of radial spacers are attached to the base. A plurality of elongated package supports extend outwardly from respective radial spacers, and are adapted for carrying respective yarn packages to supply at least one end of yarn to the textile machine.

15 Claims, 5 Drawing Sheets

MULTI-PURPOSE YARN CREEL ADAPTER

TECHNICAL FIELD AND BACKGROUND

The present disclosure relates broadly to the textile industry, and more particularly to a multi-package yarn creel adapter.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure comprises a multi-package yarn creel adapter for mounting on a creel adjacent a textile machine. The exemplary yarn creel adapter includes a base designed for being carried by the creel. A plurality of radial spacers are attached to the base. A plurality of elongated package supports extend outwardly from respective radial spacers, and are adapted for carrying respective yarn packages to supply at least one end of yarn to the textile machine.

The term "package" refers broadly to any structure in the form of cones, tubes, bobbins or the like about which an endless length of yarn may be wound.

The term "creel" refers to any framework or structure (whether floor-standing, machine-mounted, or overhead) designed for supporting multiple packages.

According to another exemplary embodiment, the base comprises an elongated generally cylindrical mounting tube.

According to another exemplary embodiment, a rotatable floating package ring is carried by the mounting tube; and the plurality of radial spacers are affixed to the package ring.

According to another exemplary embodiment, first and second axially-spaced retention rings are fixed to the mounting tube on opposite sides of the floating package ring.

According to another exemplary embodiment, a spring washer is carried by the mounting tube between the first and second retention rings. The spring washer frictionally bears against the rotatable floating package ring, such that the biasing force of the spring washer holds the radial spacers and package supports in a selected orientation relative to the textile machine.

According to another exemplary embodiment, each of the elongated package supports comprises a mounting bracket attached to the radial spacer, and an adjustable package shaft assembly attached to the mounting bracket.

According to another exemplary embodiment, the mounting bracket comprises a substantially arcuate slot defining an angle adjustment range through which the package shaft assembly may be pivoted relative to the base.

According to another exemplary embodiment, the radial spacer defines a substantially linear slot defining a radial adjustment range through which the package shaft assembly may be shifted radially relative to the base.

According to another exemplary embodiment, the package shaft assembly comprises first and second outer shafts, and a spring-biased outwardly angled package retainer.

In another exemplary embodiment, the disclosure comprises a yarn creel located adjacent a textile machine, and incorporating one or more multi-package yarn creel adapter.

In yet another exemplary embodiment, the disclosure comprises a method for supplying yarn from a creel to a textile machine. The method includes removably mounting a creel adapter on a single support element of the creel. The creel adapter includes a plurality of elongated package supports. A plurality of yarn packages are then located on respective package supports of the creel adapter. A trailing end of one yarn package carried by the creel adapter is tied (e.g., pigtailed) to a leading end of another yarn package carried by the creel adapter.

According to another exemplary embodiment, the method includes selectively adjusting at least one of the rotational, angle, and radial orientation of the package support relative to the support element of the creel.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
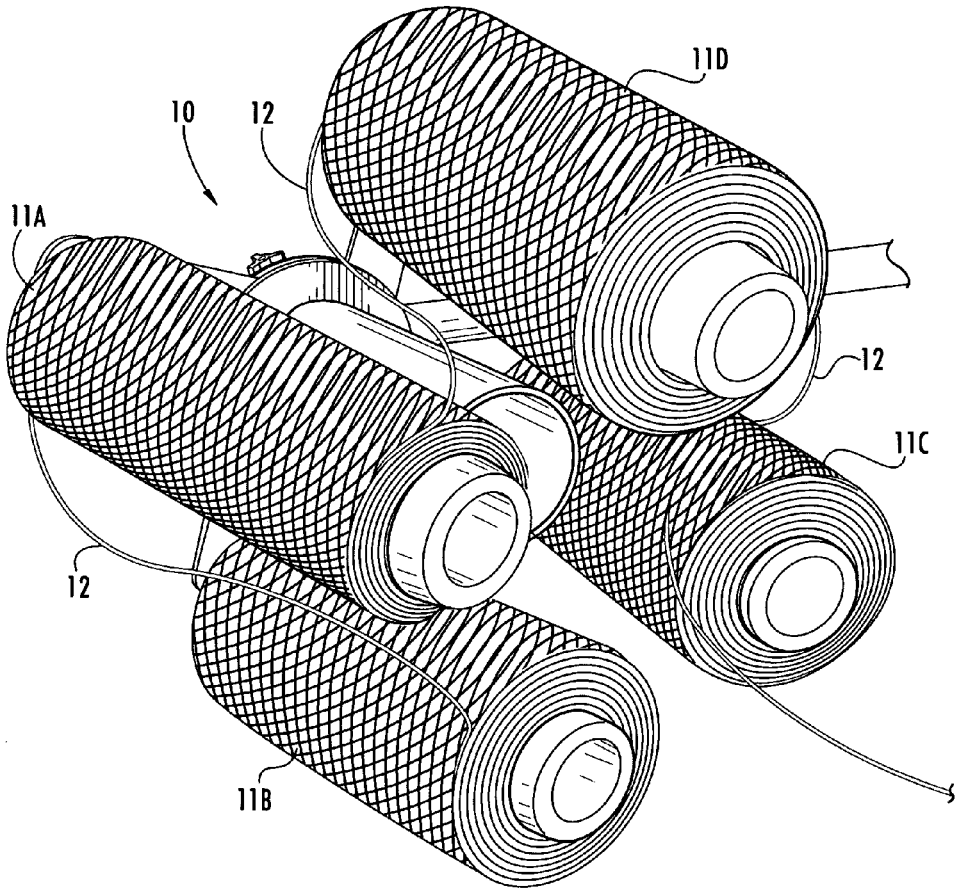
FIG. 1 is an environmental perspective view of an adjustable yarn creel adapter according to one exemplary embodiment of the present disclosure.
Figure 2:
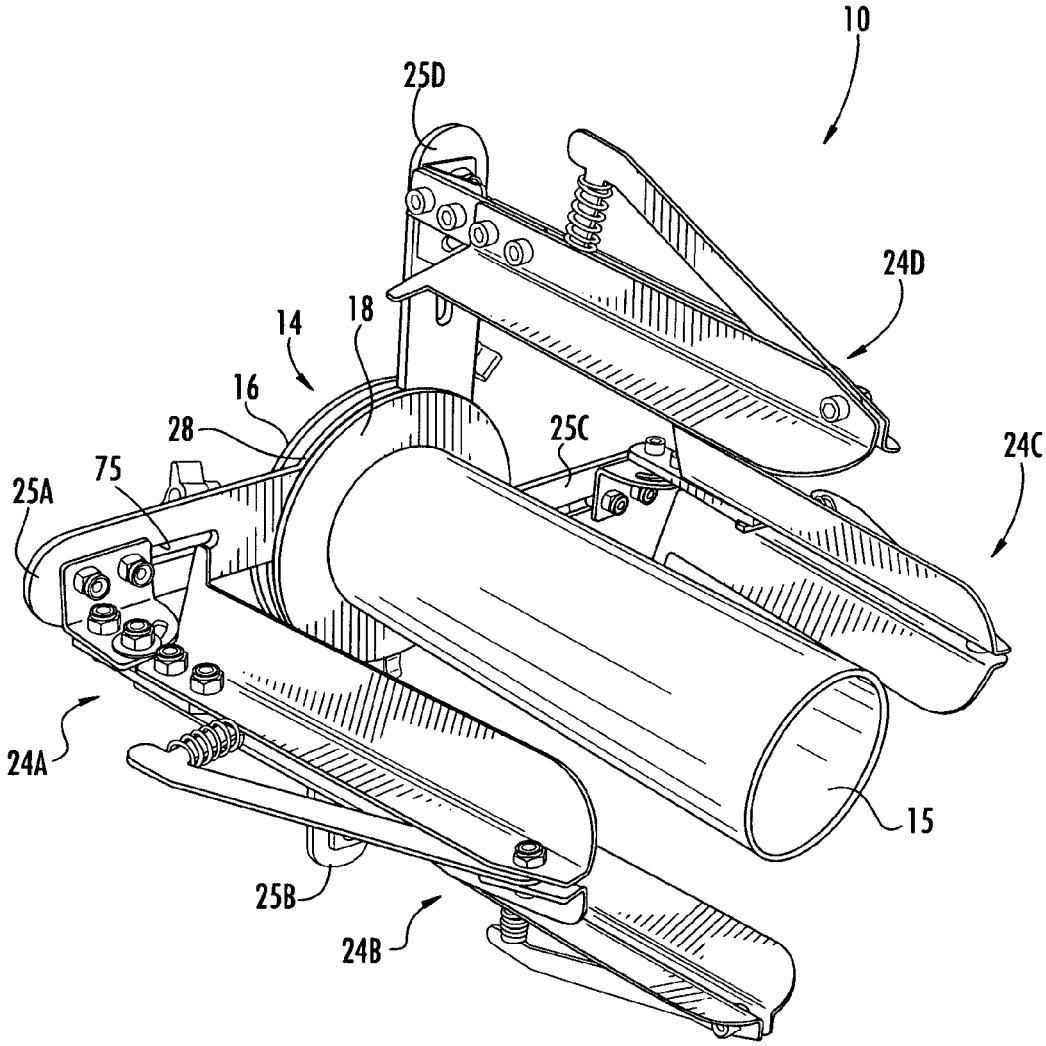
FIG. 2 is a further perspective view of the exemplary yarn creel adapter with the yarn packages removed.

Referring now specifically to the drawings, a yarn creel adapter according to one exemplary embodiment of the present disclosure is illustrated in FIGS. 1 and 2, and shown generally at reference numeral 10. The exemplary adapter 10 mounts on a conventional creel (not shown) via a single outwardly-projecting creel pin or rod, such as pin "P" shown in FIG. 5. Such creels may comprise an upright, floor-standing, longitudinal framework from which a number of creel pins (or rods) extend in rows and columns to support yarn packages for off-winding yarn to a nearby textile machine. Conventional creels of this general type are constructed to a fixed size and fixed package storage capacity. The present exemplary creel adapter 10 is designed to carry multiple, variable-sized yarn packages 11A, 11B, 11C, 11D on a single creel pin. The yarn packages 11A-11D carried by the adapter 10 may be spliced together (e.g., double-tied or "pigtailed") at indicated at reference numeral 12, such that the terminal end of the yarn of one package is attached to the beginning end of the yarn on another package so that when one package is exhausted the yarn continues off-winding from the other package to the textile machine.

Figure 3:
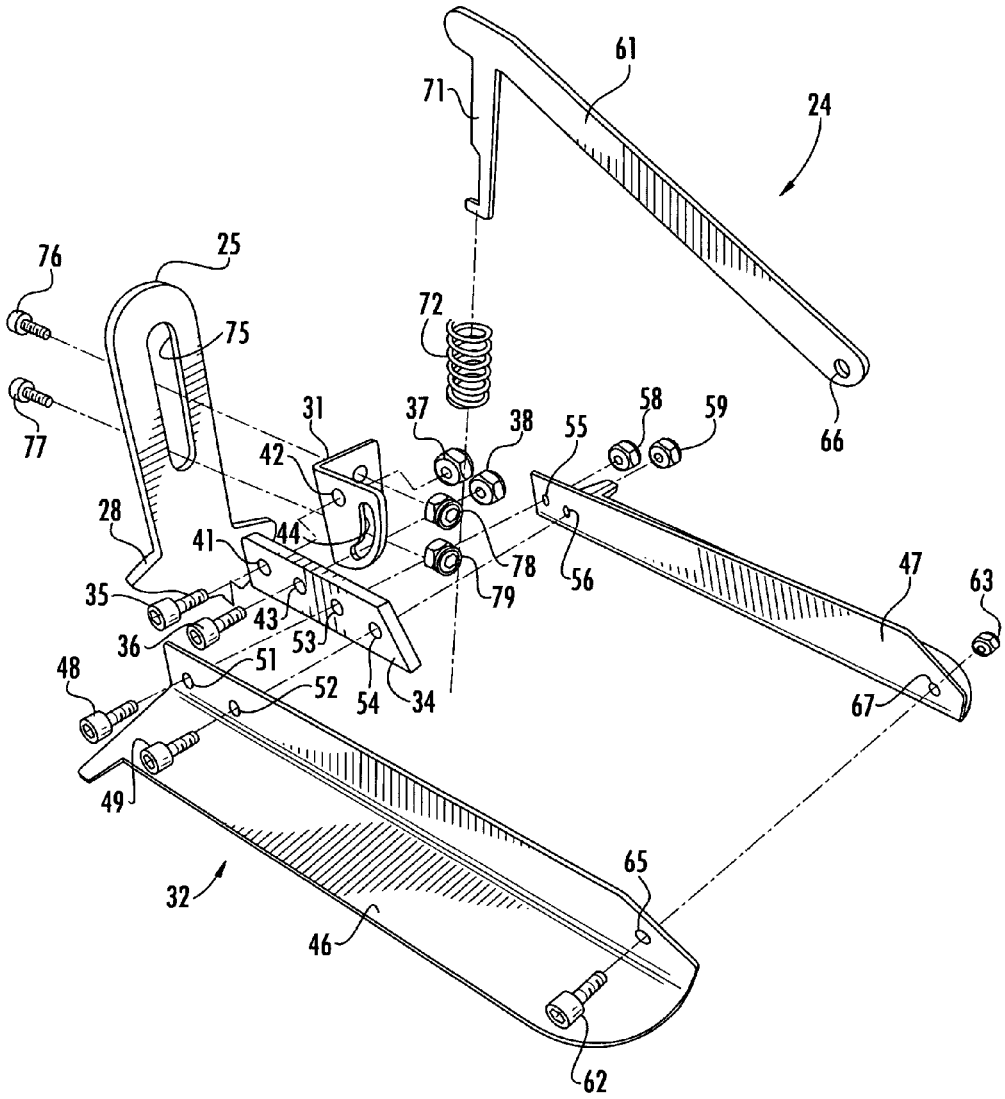
FIG. 3 is an exploded view of a single adjustable package support.

Referring to FIGS. 2 and 3, the exemplary adapter 10 includes a creel-mounting base 14 comprising an elongated cylindrical mounting tube 15, and first and second axially-spaced retention rings 16, 18 immovably fixed to the tube 15 adjacent its proximal end. The mounting tube 15 fits onto the creel pin "P" (FIG. 5), and may be releasably clamped and secured to the creel using threaded bolts 21. Each bolt 21 may have a convenient hand knob 22 for being gripped and turned to selectively lock and release the adapter 10. The yarn packages 11A-11D are carried on respective adjustable package supports 24A, 24B, 24C, 24D. In the exemplary embodiment shown, the creel adapter 10 incorporates four equally-spaced adjustable package supports 24A-24D, although any number of supports are contemplated herein. The package supports 24A-24D are attached to respective radial spacers 25A, 25B, 25C, 25D and extend outwardly from the creel towards the textile machine. The radial spacers 25A-25D are integrally formed at their respective proximal ends with a spring-biased "floating" package ring 28 which may be rotatably carried by the adapter base 14, as described further below. In the exemplary embodiment, the radial spacers 25A-25D and package ring 28 are integrally-formed together as a single homogenous unit.

Figure 4:
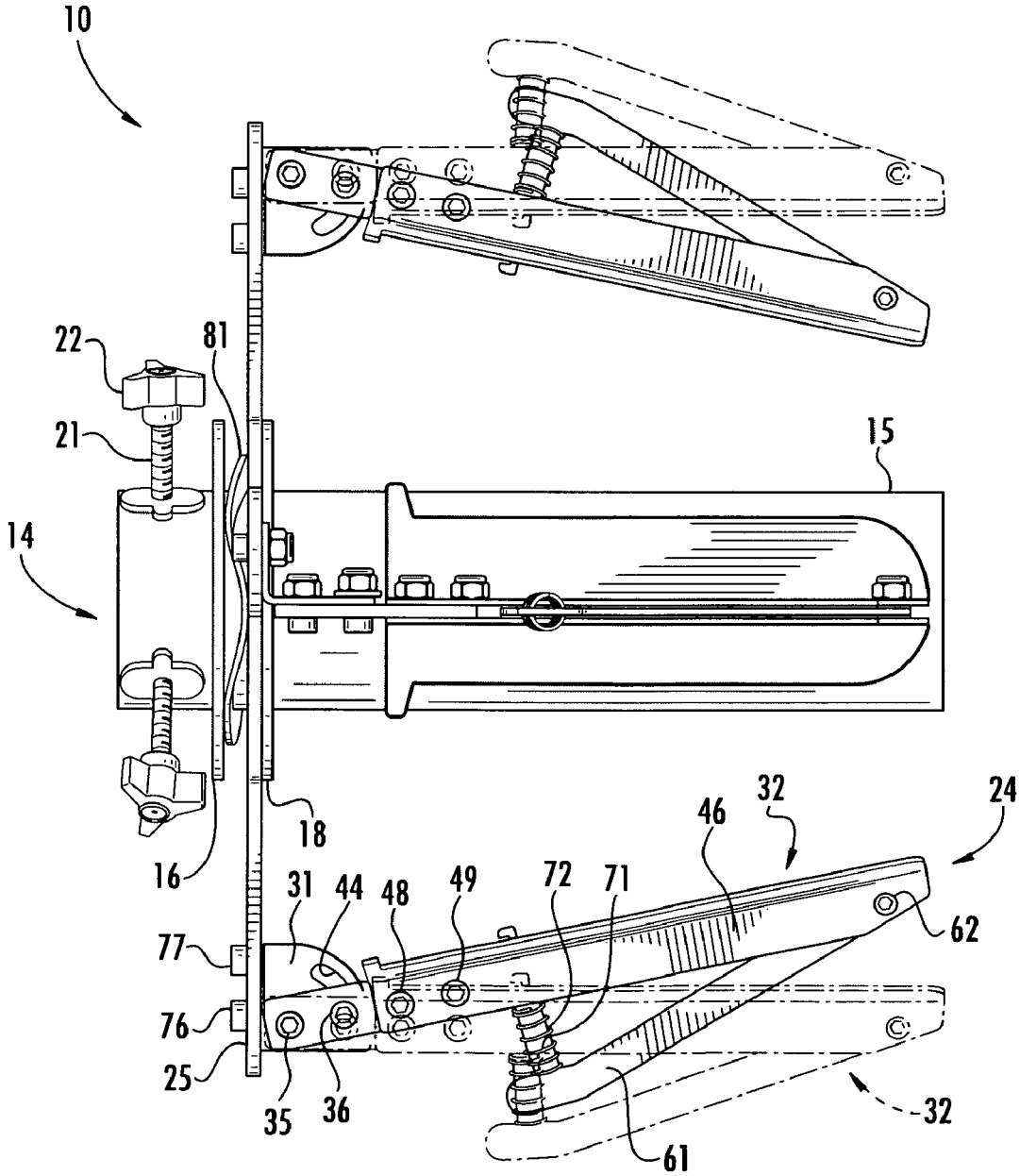
FIG. 4 is a side view of the exemplary yarn creel adapter.

As best shown in FIGS. 3 and 4, each adjustable package support 24 (representing any of 24A-24D) comprises a mounting bracket 31 attached at a distal end of the radial spacer 25 (representing any of spacers 25A-25D), and a package shaft assembly 32 pivotably attached to the mounting bracket 31. The package shaft assembly 32 includes a shaft connector 34 attached to the mounting bracket 31 using cooperating threaded bolts 35, 36 and nuts 37, 38. Bolt 35 extends through aligned openings 41, 42 in the shaft connector 34 and mounting bracket 31; the aligned openings 41, 42 defining a shaft pivot point. Bolt 36 extends through an adjacent opening 43 in the shaft connector 34, and through an arcuate slot 44 formed with the mounting bracket 31. The arcuate slot 44 defines an angle adjustment range through which the package shaft assembly 32 may be pivoted (or tilted) relative to the mounting tube 15, as demonstrated in FIGS. 4 and 5 and indicated at direction arrow 45. The package shaft assembly 32 further comprises first and second elongated angled outer shafts 46, 47 attached to the shaft connector 34 via bolts 48, 49 extending through respective aligned openings 51, 52, 53, 54, 55, 56, and secured using complementary threaded nuts 58, 59.

The exemplary package shaft assembly 32 may further comprise a spring-biased outwardly angled package retainer 61 intermediate the outer shafts 46, 47, and pivotably attached at distal ends of the outer shafts 46, 47 using a complementary threaded bolt 62 and nut 63. The bolt 62 extends through aligned openings 65, 66, 67 defining a retainer pivot point. The package retainer 61 comprises an integrally-formed substantially perpendicular dogleg 71 adjacent its proximal end, and designed to carry a coiled spring 72. The spring 72 engages the outer shafts 46, 47 of the package shaft assembly 32 such that the package retainer 61 is normally biased in an outwardly-extending angle from the retainer pivot point (at bolt 62). When a yarn package 11A-11D is applied to the shaft assembly 32, the package retainer 61 pivots inwardly against the biasing force of the spring 72, as indicated by arrow 73 in FIG. 5, and bears against an interior of the yarn package 11A-11D to frictionally hold the package on the shaft assembly 32.

Referring again to FIG. 3, the distal end of each radial spacer 25 may define a linear slot 75 through which cooperating threaded bolts 76, 77 extend to attached the mounting bracket 31 of the package support 24. The bolts 76, 77 mate with complementary threaded nuts 78, 79. The linear slot 75 defines a radial adjustment range through which the mounting bracket 31 and package shaft assembly 32 may be shifted radially relative to the mounting tube 15, as indicated by direction arrow 80 in FIG. 5.

Figure 5:
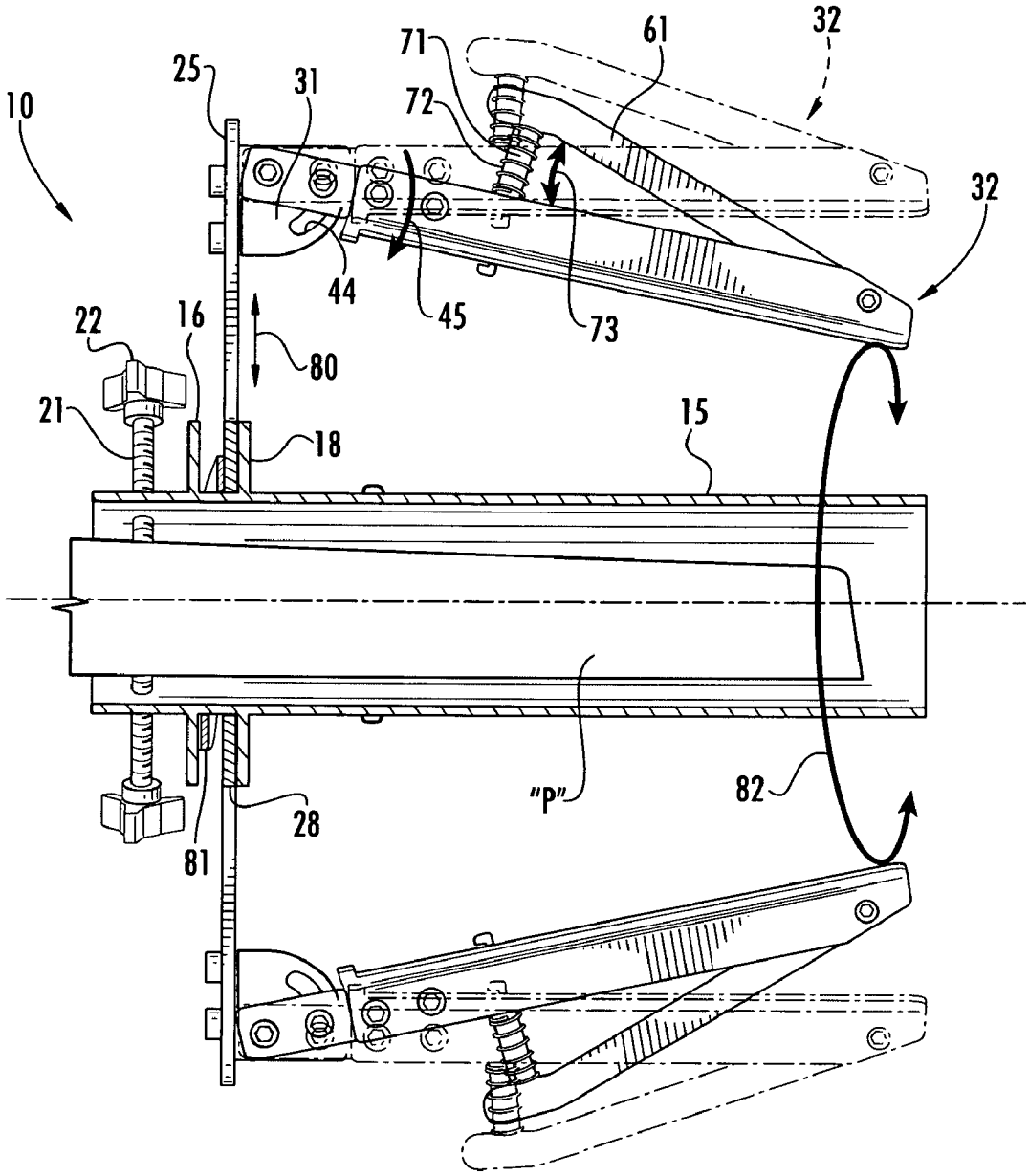
FIG. 5 is a further side view of the exemplary yarn creel adapter with various parts shown in cross-section.

As best shown in FIGS. 4 and 5, the package supports 24 of the creel adapter 10 may be rotatably oriented relative to the textile machine, as desired, by rotating the floating package ring 28 about the proximal end of the mounting tube 15. In the exemplary embodiment, a spring washer 81 resides between the first retention ring 16 of the mounting tube 15 and the floating package ring 28, and functions to urge the package ring 28 outwardly into frictional engagement with the second retention ring 18. This frictional engagement is sufficient to hold the package ring 28 and attached package supports 24 in any selected angular orientation. To adjust the angular orientation of the package supports 24, the user pushes the package supports 24 and integrally-formed package ring 28 inwardly towards the creel and against the biasing force of the spring washer 81 while simultaneously rotating the package ring 28 about the mounting shaft 15, as indicated by direction arrow 82.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. A multi-package yarn creel adapter for mounting on a creel adjacent a textile machine, said yarn creel adapter comprising:

a base designed for being carried by the creel;

a plurality of radial spacers attached to said base;

said base comprising an elongated generally cylindrical mounting tube extending outwardly from said spacers;

a rotatable floating package ring carried by said mounting tube, and wherein said plurality of radial spacers are affixed to said package ring;

a plurality of elongated package supports extending outwardly from respective radial spacers in the same direction of said mounting tube, and adapted for carrying respective yarn packages to supply at least one end of yarn to the textile machine.

2. A multi-package yarn creel adapter according to claim 1, and comprising first and second axially-spaced retention rings fixed to said mounting tube on opposite sides of said floating package ring.

3. A multi-package yarn creel adapter according to claim 2, and comprising a spring washer carried by said mounting tube between said first and second retention rings, and frictionally bearing against said rotatable floating package ring, such that the biasing force of said spring washer holds said radial spacers and package supports in a selected orientation relative to the textile machine.

4. A multi-package yarn creel adapter according to claim 1, wherein each elongated package support comprises a mounting bracket attached to said radial spacer, and an adjustable package shaft assembly attached to said mounting bracket.

5. A multi-package yarn creel adapter according to claim 4, wherein said mounting bracket comprises a substantially arcuate slot defining an angle adjustment range through which said package shaft assembly may be pivoted relative to said base.

6. A multi-package yarn creel adapter according to claim 4, wherein said radial spacer defines a substantially linear slot defining a radial adjustment range through which said package shaft assembly may be shifted radially relative to said base.

7. A multi-package yarn creel adapter according to claim 4, wherein said package shaft assembly comprises first and second outer shafts, and a spring-biased outwardly angled package retainer intermediate said outer shafts.

8. In a yarn creel located adjacent a textile machine, a multi-package yarn creel adapter comprising:

a base designed for being carried by the creel;

a plurality of radial spacers attached to said base;

said base comprising an elongated generally cylindrical mounting tube extending outwardly from said spacers;

a rotatable floating package ring carried by said mounting tube, and wherein said plurality of radial spacers are affixed to said package ring;

a plurality of elongated package supports extending outwardly from respective radial spacers in the same direction of said mounting tube, and adapted for carrying respective yarn packages to supply at least one end of yarn to the textile machine.

9. A yarn creel according to claim 8, and comprising first and second axially-spaced retention rings fixed to said mounting tube on opposite sides of said floating package ring.

10. A yarn creel according to claim 9, and comprising a spring washer carried by said mounting tube between said first and second retention rings and frictionally bearing against said rotatable floating package ring, such that the biasing force of said spring washer holds said radial spacers and package supports in a selected orientation relative to the textile machine.

11. A yarn creel according to claim 8, wherein each elongated package support of said yarn creel adapter comprises a mounting bracket attached to said radial spacer, and an adjustable package shaft assembly attached to said mounting bracket.

12. A yarn creel according to claim 11, wherein said mounting bracket comprises a substantially arcuate slot defining an angle adjustment range through which said package shaft assembly may be pivoted relative to said base.

13. A yarn creel according to claim 11, wherein said radial spacer defines a substantially linear slot defining a radial adjustment range through which said package shaft assembly may be shifted radially relative to said base.

14. A yarn creel according to claim 11, wherein said package shaft assembly comprises first and second outer shafts, and a spring-biased outwardly angled package retainer intermediate said outer shafts.

15. A multi-package yarn creel adapter for mounting on a creel adjacent a textile machine, said yarn creel adapter comprising:

a base designed for being carried by the creel, and comprising an elongated generally cylindrical mounting tube;

a rotatable floating package ring carried by said mounting tube;

first and second axially-spaced retention rings fixed to said mounting tube on opposite sides of said rotatable floating package ring;

a plurality of radial spacers affixed to said package ring;

a plurality of elongated package supports extending outwardly from respective radial spacers, and adapted for carrying respective yarn packages to supply at least one end of yarn to the textile machine; and a spring washer carried by said mounting tube between said first and second retention rings, and frictionally bearing against said rotatable floating package ring, such that the biasing force of said spring washer holds said radial spacers and package supports in a selected orientation relative to the textile machine.

* * * * *